US008082751B2

(12) United States Patent
Wiggs

(10) Patent No.: US 8,082,751 B2
(45) Date of Patent: Dec. 27, 2011

(54) DX SYSTEM WITH FILTERED SUCTION LINE, LOW SUPERHEAT, AND OIL PROVISIONS

(75) Inventor: B. Ryland Wiggs, Franklin, TN (US)

(73) Assignee: Earth to Air Systems, LLC, Franklin, TN (US)

( * ) Notice: Subject to any disclaimer, the term of this patent is extended or adjusted under 35 U.S.C. 154(b) by 673 days.

(21) Appl. No.: 12/267,252

(22) Filed: Nov. 7, 2008

(65) Prior Publication Data

US 2009/0120120 A1 May 14, 2009

Related U.S. Application Data

(60) Provisional application No. 60/986,707, filed on Nov. 9, 2007.

(51) Int. Cl.
*F25B 43/02* (2006.01)

(52) U.S. Cl. ..... 62/468; 62/84

(58) Field of Classification Search ..... 62/84, 324.4, 62/468, 470

See application file for complete search history.

(56) References Cited

U.S. PATENT DOCUMENTS

| | | | | |
|---|---|---|---|---|
| 2,503,456 | A | | 4/1950 | Smith |
| 3,099,140 | A | | 7/1963 | Leimbach |
| 3,183,675 | A | | 5/1965 | Schroeder |
| 3,452,813 | A | | 7/1969 | Watkins et al. |
| 3,978,685 | A | * | 9/1976 | Taylor ..... 62/471 |
| 3,986,345 | A | | 10/1976 | Pilz et al. |
| 4,010,731 | A | | 3/1977 | Harrison |
| 4,094,356 | A | | 6/1978 | Ash et al. |
| 4,169,554 | A | | 10/1979 | Camp |
| 4,182,133 | A | | 1/1980 | Haas et al. |
| 4,189,848 | A | | 2/1980 | Ko et al. |
| 4,224,805 | A | | 9/1980 | Rothwell |
| 4,257,239 | A | | 3/1981 | Partin et al. |
| 4,286,651 | A | | 9/1981 | Steiger et al. |
| 4,290,266 | A | | 9/1981 | Twite et al. |
| 4,325,228 | A | | 4/1982 | Wolf |
| 4,375,831 | A | | 3/1983 | Downing, Jr. |
| 4,378,787 | A | | 4/1983 | Fleischmann |
| 4,383,419 | A | | 5/1983 | Bottum |
| 4,392,531 | A | | 7/1983 | Ippolito |
| 4,448,237 | A | | 5/1984 | Riley |
| 4,448,238 | A | | 5/1984 | Singleton et al. |
| 4,459,752 | A | | 7/1984 | Babcock |
| 4,536,765 | A | | 8/1985 | Kaminski |
| 4,538,673 | A | | 9/1985 | Partin et al. |
| 4,544,021 | A | | 10/1985 | Barrett |
| 4,557,115 | A | | 12/1985 | Nakamura |
| 4,700,550 | A | | 10/1987 | Rhodes |
| 4,715,429 | A | | 12/1987 | Mogensen |
| 4,741,388 | A | | 5/1988 | Kuroiwa |

(Continued)

FOREIGN PATENT DOCUMENTS

KR 10-2002-0071232 9/2002

(Continued)

*Primary Examiner* — Melvin Jones

(74) *Attorney, Agent, or Firm* — Miller, Matthias & Hull LLP

(57) ABSTRACT

A heating/cooling system has improved operating efficiencies due to low superheat provisions and a specially configured compressor oil return. For certain systems, such as direct exchange geothermal heating/cooling applications having sub-surface heat exchanges extending at least 100 feet below the surface and using R-410A refrigerant, a specific compressor oil may be used to further improve efficiency.

16 Claims, 1 Drawing Sheet

U.S. PATENT DOCUMENTS 4,798,056 A 1/1989 Franklin
4,858,679 A 8/1989 Sakaya et al.
4,858,694 A 8/1989 Johnson et al.
4,867,229 A 9/1989 Mogensen
4,936,110 A 6/1990 Kuckens
4,993,483 A 2/1991 Harris
5,025,634 A 6/1991 Dressler
5,025,641 A 6/1991 Broadhurst
5,029,633 A 7/1991 Mann
5,038,580 A 8/1991 Hart
5,054,297 A 10/1991 Furuhama
5,062,276 A 11/1991 Dudley
5,105,633 A 4/1992 Briggs
5,131,238 A 7/1992 Meckler
5,136,855 A 8/1992 Lenarduzzi
5,199,486 A 4/1993 Balmer et al.
5,207,075 A 5/1993 Gundlach
5,224,357 A 7/1993 Galiyano
5,275,008 A 1/1994 Song et al.
5,277,032 A 1/1994 See et al.
5,313,804 A 5/1994 Kaye
5,369,958 A * 12/1994 Kasai et al. ..... 62/158
5,381,672 A 1/1995 Haasis
5,383,337 A 1/1995 Baker
5,388,419 A 2/1995 Kaye
5,419,135 A 5/1995 Wiggs
5,461,876 A 10/1995 Dressler
5,477,703 A 12/1995 Hanchar et al.
5,477,914 A 12/1995 Rawlings
5,533,355 A 7/1996 Rawlings
5,560,220 A 10/1996 Cochran
5,561,985 A 10/1996 Cochran
5,564,282 A 10/1996 Kaye
5,570,590 A * 11/1996 Hansen et al. ..... 62/472
5,598,887 A 2/1997 Ikeda et al.
5,605,058 A 2/1997 Kurachi et al.
5,622,057 A 4/1997 Bussjager et al.
5,623,986 A 4/1997 Wiggs
5,651,265 A 7/1997 Grenier
5,671,608 A 9/1997 Wiggs et al.
5,706,888 A 1/1998 Ambs et al.
5,725,047 A 3/1998 Lopez
5,738,164 A 4/1998 Hildebrand
5,758,514 A 6/1998 Genung
5,771,700 A 6/1998 Cochran
5,816,314 A 10/1998 Wiggs et al.
5,875,644 A 3/1999 Ambs et al.
5,934,087 A 8/1999 Watanabe et al.
5,937,665 A 8/1999 Kiessel et al.
5,937,934 A 8/1999 Hildebrand
5,941,238 A 8/1999 Tracy
5,946,928 A * 9/1999 Wiggs ..... 62/260
6,138,744 A 10/2000 Coffee
6,212,896 B1 4/2001 Genung
6,227,003 B1 5/2001 Smolinsky
6,276,438 B1 8/2001 Amerman et al.
6,354,097 B1 3/2002 Schuster
6,390,183 B2 5/2002 Aoyagi et al.
6,450,247 B1 9/2002 Raff
6,521,459 B1 2/2003 Schooley et al.
6,615,601 B1 9/2003 Wiggs
6,751,974 B1 6/2004 Wiggs
6,789,608 B1 9/2004 Wiggs
6,892,522 B2 5/2005 Brasz et al.
6,931,879 B1 8/2005 Wiggs
6,932,149 B2 8/2005 Wiggs
6,971,248 B1 12/2005 Wiggs
7,080,524 B2 7/2006 Wiggs
7,146,823 B1 12/2006 Wiggs
7,191,604 B1 3/2007 Wiggs
7,234,314 B1 6/2007 Wiggs
7,401,641 B1 7/2008 Wiggs
2002/0132947 A1 9/2002 Smith et al.
2002/0194862 A1 12/2002 Komatsubara et al.

FOREIGN PATENT DOCUMENTS

WO WO-2004/027333 A2 4/2004
WO WO-2004/013551 A1 12/2004
WO WO-2005/114073 A2 12/2005
WO WO-2007/046788 A2 4/2007

* cited by examiner

DX SYSTEM WITH FILTERED SUCTION LINE, LOW SUPERHEAT, AND OIL PROVISIONS

CROSS-REFERENCE TO RELATED APPLICATION

The present application claims the benefit of U.S. Provisional Application Ser. No. 60/986,707, filed on Nov. 9, 2007, the entirety of which is incorporated herein by reference.

FIELD OF THE DISCLOSURE

The present disclosure relates to geothermal direct exchange ("DX") heating/cooling systems, which are also commonly referred to as "direct exchange" and/or "direct expansion" heating/cooling systems.

BACKGROUND OF THE DISCLOSURE

Geothermal ground source/water source heat exchange systems typically include closed loops of tubing that are buried in the ground, or submerged in a body of water. Fluid is circulated through the loops of tubing so that the fluid either absorbs heat from or rejects heat into the naturally occurring geothermal mass and/or water surrounding the tubing. The ends of the tubing loop extend to the surface and are fluidly coupled to an interior air heat exchanger. The naturally warmed or cooled fluid is circulated through the interior air heat exchanger to warm or cool an interior space.

Common and older geothermal water-source heating/cooling systems typically have a pump for circulating a fluid comprised of water, or water with anti-freeze, in plastic (typically polyethylene) underground geothermal tubing so as to transfer geothermal heat to or from the ground in a first heat exchange step. In a second heat exchange step, a refrigerant heat pump system transfers heat to or from the water. Finally, in a third heat exchange step, an interior air handler (comprised of finned tubing and a fan) transfers heat to or from the refrigerant to heat or cool interior air space.

Newer design geothermal DX heat exchange systems have only two heat exchange steps. DX systems typically have refrigerant fluid transport lines placed directly in the sub-surface ground and/or water. The sub-surface refrigerant lines are typically comprised of copper tubing. A refrigerant fluid, such as R-22, or the like, is circulated through the lines to transfer geothermal heat to or from the sub-surface elements in a first heat exchange step. DX systems only require a second heat exchange step to transfer heat to or from the interior air space, typically by means of an interior air handler. Consequently, DX systems use fewer heat exchange steps and do not require power to run a water pump, and therefore are generally more efficient than water-source systems. Further, since copper is a better heat conductor than most plastics, and since the refrigerant fluid circulating within the copper tubing of a DX system generally has a greater temperature differential with the surrounding ground than the water circulated through the plastic tubing of a water-source system, generally, less excavation and drilling is required, thereby decreasing installation costs.

While most in-ground/in-water DX heat exchange designs are feasible, various improvements have been developed to enhance overall system operational efficiencies. Several such design improvements, particularly in direct expansion/direct exchange geothermal beat pump systems, are taught in U.S. Pat. No. 5,623,986 to Wiggs; U.S. Pat. No. 5,816,314 to Wiggs, et al.; U.S. Pat. No. 5,946,928 to Wiggs; and U.S. Pat. No. 6,615,601 B1 to Wiggs, the disclosures of which are incorporated herein by reference. Such disclosures encompass both horizontally and vertically oriented sub-surface heat geothermal heat exchange means.

Conventional DX system typically heat or cool at least one control medium. A control medium could be, for example, water, water and/or antifreeze, a solid (such as concrete), or a vapor (such as air in an interior room). In a conventional DX system design, the control medium is air in an interior space, and the sub-surface geothermal heat exchange tubing provides heat to the interior air by means of an interior air-handler. In a conventional DX system design, the system is used to either heat or cool, but is not designed to simultaneously heat and cool different control media or similar control media located in different interior spaces.

It is advantageous to maintain or increase the operational efficiencies of a DX system. The subject matter disclosed herein primarily relates to various improvements that will maintain or increase system operational efficiencies

SUMMARY OF THE DISCLOSURE

The exemplary DX systems disclosed herein advantageously maintain or increase system operational efficiencies by providing an optimum superheat level; providing mostly refrigerant vapor to the compressor; and providing a preferred compressor lubricating oil and oil return means for a DX system using an R-410A refrigerant, particularly when the sub-surface geothermal heat exchange tubing of the DX system is installed in deep wells, exceeding 100 feet in depth.

Maintaining a very low superheat, but at a temperature above a zero superheat, may increase system operational efficiencies. If the superheat is too low, being very near to or at the refrigerant saturation level and/or very near to or at zero degrees F, as taught in U.S. Pat. No. 6,058,719 to Cochran, two problems are encountered. First, ice very quickly builds up on any un-insulated portion of the suction line within the compressor box (particularly in the heating mode, since vaporizing liquid within the suction refrigerant transport lines traveling to the compressor removes heat from the lines and the cold lines freeze condensing moisture coming from the air), thereby increasing concerns with water, mold, and mildew buildup as the ice periodically melts. Second, at or slightly below zero superheat, some liquid phase refrigerant is necessarily pulled into the system's compressor, which compressor attains maximum efficiencies via compressing only vapor state refrigerant.

The '719 patent achieves near (slightly below, of necessity, as hereinafter explained so as to effect oil return), or at, zero superheat conditions by means of thoroughly mixing liquid phase refrigerant in a refrigerant storage container with incoming refrigerant fluid (mostly vapor) from the heat exchanger utilized. The resulting thorough mixture of saturated refrigerant vapor and refrigerant liquid pulled into the compressor does have enough liquid form refrigerant to carry refrigerant oil back to the compressor, after the oil has circulated throughout Cochran's entire system in conjunction with the refrigerant. However, again, liquid phase refrigerant impairs the operational efficiency of the compressor, and may excessively dilute the lubricating oil within the compressor itself via flow through of too much liquid phase refrigerant, thereby shortening compressor life. Cochran's design, therefore, must supply saturated refrigerant vapor (which is present at zero degrees superheat) to the compressor, as he has neither indicated nor shown nor described any other compressor lubricant oil return means. Since oil can be carried back into the compressor via tiny liquid refrigerant molecules/ droplets, or the like, (which liquid phase molecules/droplets exit at saturation, or lesser, temperatures) Cochran must return saturated refrigerant, containing at least some liquid phase refrigerant, back to the compressor, or his compressor would eventually burn out.

In conventional heat pump systems, the compressor lubricating oil mixes with the vapor refrigerant as well as the liquid phase refrigerant in the bottom of standard accumulators. The oil that has mixed with the liquid phase refrigerant is typically pulled back into (and returned to) the compressor by means of a small orifice in the bottom of a suction line U-tube disposed within the accumulator (the top of the U tube within the accumulator primarily limits the refrigerant being pulled into the compressor to one of a mostly vapor state). The orifice size for oil return at the bottom of the U bend suction line within the accumulator, in most conventional two to five ton compressors, for example, is about 0.04 inches to 0.055 inches in diameter (diameter orifices are proportionately larger for larger compressor sizes).

However, in addition to providing a means to return oil to the compressor in conventional systems, some liquid phase refrigerant is also pulled into the compressor. While the amount of liquid phase refrigerant pulled into the compressor is relatively small, and therefore the compressor is normally not "slugged" or otherwise materially damaged, the presence of liquid phase refrigerant may impair compressor operational efficiencies. Further, so as to intentionally avoid slugging compressors, compressor manufacturers typically call for the maintenance of 15 degrees to 25 degrees superheat. While this superheat level helps protect the compressor from being slugged (slugging occurs via suctioning too much liquid phase refrigerant through the compressor, which is designed to compress vapor and not liquid), it may impair the operational efficiencies of the heating/cooling system, which are maximized at a point as close as possible to, but still above, zero degrees superheat, so long as not too much liquid phase refrigerant enters the compressor. Through testing, applicant has found that keeping superheat levels between 0.5 and 10 degrees provides optimum operational efficiencies in a DX system.

Cochran further uses eight holes, which are about 0.077 inches in diameter, in approximately 4 to 5 ton system designs for example, to achieve at or slightly below zero superheat refrigerant saturation level in the suction line to the compressor, and to return oil to the compressor. Consequently, Cochran's system introduces increased levels of liquid phase refrigerant back into the compressor, to an even greater extent than other conventional heat pump system designs, such as air-source heat pump system designs for example. While Cochran teaches the use of a deflector shield to help prevent excessive amounts of liquid from being pulled into the compressor, it still introduces more liquid phase refrigerant into the compressor than other conventional designs, which, as previously explained, can impair system operational efficiencies and/or can shorten compressor life.

A preferable objective would be to maintain a very low superheat level, preferably between 0.5 degrees F. and 10 degrees F., in the suction line to the compressor, so as to maintain low compressor operating temperatures, thereby extending compressor life and reducing operational power requirements. The above is achieved while minimizing the amount of liquid phase refrigerant required to be returned to the compressor itself and providing adequate return of lubricating oil to the compressor.

Extensive testing has demonstrated that this objective is accomplished by means of adjusting the desired amount of return refrigerant vapor released into the accumulator, at adjustment points above and below the liquid phase refrigerant within the system's accumulator, by providing moderately sized holes within the wall of the return vapor refrigerant transport line within the accumulator, at selected and preferred locations, within the accumulator itself.

Testing has shown that to decrease or lower superheat, one should decrease the number and/or size of the upper holes within the suction refrigerant supply line, which are situated above the liquid state refrigerant within the within the accumulator, and increase the number and/or size of lower holes within the suction refrigerant supply line, which are situated below the liquid state refrigerant within the accumulator. The total number and area size of holes/ports, both above and below the liquid phase refrigerant within the bottom portion of the accumulator, may be equal the total area size of the interior open distal end of the suction refrigerant supply line within the accumulator, which interior open distal end of the suction refrigerant supply line would be sealed shut when holes are provided in the side of the suction refrigerant supply line within the accumulator.

Testing has shown that to increase or raise superheat, one should increase the number and/or size of upper holes within the suction refrigerant supply line, which are situated above the liquid state refrigerant within the within the accumulator, and decrease the number and/or size of lower holes within the suction refrigerant supply line, which situated below the liquid state refrigerant within the accumulator. The total number and area size of holes/ports, both above and below the liquid phase refrigerant within the bottom portion of the accumulator, may be equal the total area size of the interior open distal end of the suction refrigerant supply line within the accumulator, which interior open distal end of the suction refrigerant supply line would be sealed shut when holes are provided in the side of the suction refrigerant supply line within the accumulator.

Further, testing has indicated the best design, so as to operate within a preferable low superheat temperature range, above zero but less than 10 degrees, is to leave the lower bottom distal end of the suction refrigerant supply line, which supply line is within the accumulator and is positioned below the liquid state refrigerant, completely open, so that there is only one hole below the liquid phase refrigerant level, and so that there are no holes above the liquid level within the accumulator. Testing has shown that the refrigerant vapor bubbles exiting the open lower distal end of the suction refrigerant supply line to, and within, the accumulator, when positioned below the liquid phase refrigerant level within the accumulator, are large enough so as not to effect full saturation of the refrigerant entering the suction line to the compressor. However, the vapor refrigerant bubbles are of adequate size to mix with the liquid refrigerant within the bottom portion of the accumulator so as to maintain operational superheat levels between 0.5 degrees F. and 10 degrees F.

Simultaneously, at such low superheat levels, testing has demonstrated that the amount of liquid phase refrigerant entering the compressor may be minimized by installing a liquid refrigerant filter at or near the intake point of the suction line to the compressor within the accumulator. The liquid refrigerant filter may be of any type that is non-corrosive to refrigerant transport tubing, and that is non-corrosive to steel and other refrigeration parts/equipment/fittings, so long as the filter prevents one of all and mostly all liquid phase refrigerant from flowing through, and solely permits one of all and mostly all vapor phase refrigerant flow.

Additionally, an oil separator may be used with an oil filter that preferably removes about 99%, or more, of the oil from the compressor, so as to minimize the amount of oil that is entrained within the liquid at the bottom of the accumulator. For example, the filter may be a coalescent oil filter is capable of filtering to at least 0.3 microns and is at least 99% efficient. The oil separator may also have a sight glass to facilitate viewing of the oil level. An oil separator typically has a hinged float that opens up an oil return line to one of the compressor and the suction line to the accumulator when the oil level gets too high. Preferably, the oil is returned to a point at the suction line to the compressor, but after the suction line has exited the accumulator.

Alternatively, a helical oil separator that is at least 98% efficient may be used to return oil, with the helical oil separator and the oil return line positioned as herein described for an oil separator with a highly efficient filter.

In a system using an accumulator for traditional purposes, the hot oil from an oil separator may be returned to the suction line leading to the accumulator, so as to help vaporize any unwanted liquid refrigerant in the accumulator. However, in the subject design taught herein, it is desirable to maintain a cool liquid refrigerant in the bottom portion of the accumulator so as to help maintain a low suction line superheat to the compressor. Consequently, in the subject design taught herein, the oil is returned directly to the compressor suction line, thereby by-passing the accumulator.

As an additional advantage, the use of such an efficient oil separator that by-passes the accumulator allows only minute amounts of oil to travel into the general refrigerant transport line circuitry. This provides a heat transfer advantage in the sub-surface geothermal heat exchanger and in the interior heat exchanger, as the interior walls of the refrigerant transport tubing are not coated with as much oil as in a conventional system and heat transfer is thereby improved (an oil coating on the walls of heat transfer tubing inhibits heat transfer and reduces optimum efficiencies).

Still another advantage provided, via the use of such an efficient oil separator that by-passes the accumulator, is that the oil return orifice in the bottom of the suction line U bend within a traditional accumulator may now be much smaller (such as by at least 72%) than the traditional aforesaid 0.04 inch to 0.055 inch diameter for a 2-5 ton system compressor, because materially less oil now needs to be returned via this orifice. This also means at least 28% less liquid refrigerant is now required to be pulled into the suction line to the compressor, thereby increasing compressor operational efficiencies. Thus, such a preferable 72% smaller oil return orifice would preferably have a 0.02 inch to a 0.0396 inch diameter.

However, when such a conventional/traditional accumulator is used, in conjunction with one or more of the subject disclosures as taught herein, a vapor bleed port hole may be provided near the top of the portion of the U bend that exits directly to the compressor, which vapor bleed port hole may be positioned above the liquid refrigerant level within the accumulator. The subject vapor bleed port hole prevents excessive liquid slugging within the compressor upon system start-up, which excessive slugging could otherwise be caused via liquid phase refrigerant that may have completely filled the lower portion of the U bend via the oil return orifice hole in the bottom of the U bend during system inoperative periods. The subject vapor bleed port hole, when used in conjunction with one or more of the disclosures taught herein, may have between a 0.025 inch and a 0.03 inch diameter size per ton of system design capacity. One ton equals 12,000 BTUs, and system design capacities, in tons, are typically calculated via ACCA Manual J, or the like, and are well understood by those skilled in the art.

Additionally, when such a conventional accumulator is used, in conjunction with one or more of the subject disclosures as taught herein, it would be advantageous, although not mandatory, to install a liquid refrigerant filter at the top of the suction refrigerant line (the intake to the U bend) within the accumulator that supplies the compressor. Such a filter is preferable in that it will help to safeguard against any excessive liquid phase refrigerant possibly getting into the compressor, as a result of system overcharging, or the like. However, under normal conditions, so long as the top of the suction line is safely above the liquid level within the accumulator, such a filter is not mandatory.

Rather than a conventional accumulator with an interior U bend suction line to the compressor, however, a specially designed accumulator may be used in conjunction with one or more of the subject disclosures as taught herein. Such a specially designed accumulator would have a refrigerant suction line having at least one upper hole above the liquid refrigerant level within the accumulator, and with at least one lower hole below the liquid refrigerant level within the accumulator. A refrigerant liquid filter would preferably be positioned near the top of the accumulator (above the liquid refrigerant level), with the liquid filter being directly attached to the entry segment of the suction line traveling to the compressor. Additionally, instead of a small orifice in the bottom of a U bend in the suction line within the accumulator (as would be provided in a conventional accumulator with an interior U bend), a small oil return line would preferably be extended from below the liquid refrigerant level within the accumulator to a segment of the actual direct suction line to the compressor, thereby totally by-passing the refrigerant liquid filter within the accumulator.

Testing has shown that the systems disclosed herein may be optimized when it is charged with an R-410A refrigerant, and when a scroll compressor is used, in lieu of more common reciprocal compressors. A special lubricating oil may be used with the scroll compressor, and is particularly advantageous when the system has liquid and vapor refrigerant transport tubing extending to depths in excess of 100 feet below the surface. In such deep well applications, depending on varying miscellaneous conditions, compressor hot gas discharge temperatures can periodically exceed 200 degrees F. For example, a standard compressor lubricating oil recommended by Emerson Climate Technologies, Inc., with a USA office at 1675 West Campbell Road, Sidney, Ohio 45365, which company manufactures Copeland Scroll Compressors, is Copeland Ultra 32-3MAF Polyol Ester Oil, Synthetic Refrigeration Oil, Part No. 998-E022-01. However, such oil, or the like, is fine so long as system operating temperatures remain below about 190 degrees F., but such oil can become impaired if compressor discharge temperatures exceed 200 degrees F. Therefore, for use in conjunction with the subject system designs as disclosed herein, and particularly for use in conjunction with a DX system deep well application (in excess of 100 feet deep), in conjunction with a scroll compressor operating on an R-410A refrigerant, a Hatco 32 BCE lubricating oil, or the like, should preferably be utilized, as it can withstand system operating temperatures in excess of 220 degrees F. (as can be periodically produced by the unique designs and conditions disclosed herein) without impairment, which is preferable in the applications and conditions herein described. Hatco 32 BCE lubricating oil is manufactured by the Hatco Corporation, a Chemtura Company, of 1020 King Georges Post Road, Fords, N.J. 08863.

BRIEF DESCRIPTION OF THE DRAWINGS

For a more complete understanding of the disclosed methods and apparatus, reference should be made to the embodiments illustrated in greater detail on the accompanying drawings, wherein.

It should be understood that the drawings are not necessarily to scale and the disclosed embodiments are sometimes illustrated diagrammatically in partial views. In certain instances, details which are not necessary for an understanding of the disclosed methods and apparatus, or which render other details difficult to perceive, may have been omitted. It should be understood, of course, that this disclosure is not limited to the particular embodiments illustrated herein.

DETAILED DESCRIPTION

The following detailed description is of the best presently contemplated mode of carrying out the subject matter disclosed herein. The description is not intended in a limiting sense, and is made solely for the purpose of illustrating the general principles of this subject matter. The various features and advantages of the present disclosure may be more readily understood with reference to the following detailed description taken in conjunction with the accompanying drawings.

Figure 1:
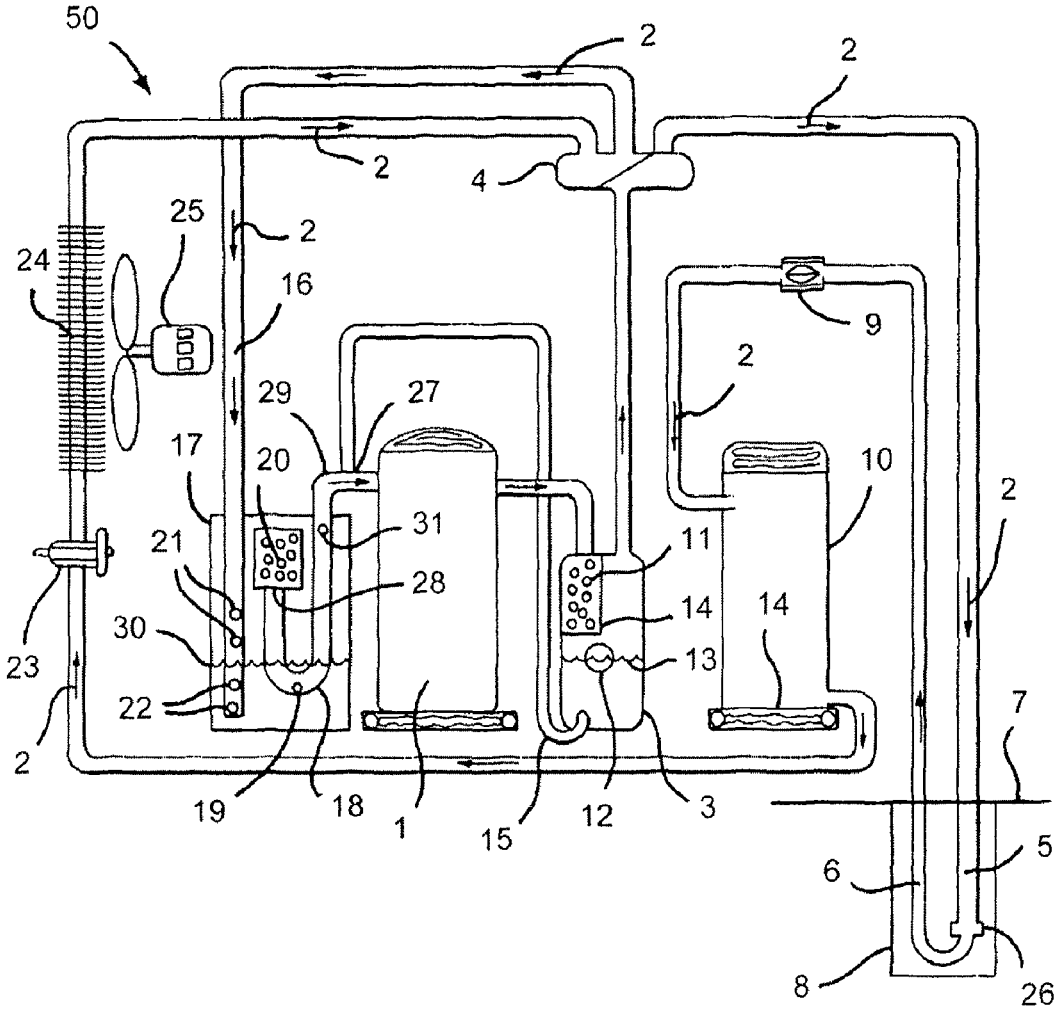
FIG. 1 is a schematic side elevation view of a DX system constructed according to the teachings of the present disclosure.

FIG. 1 shows a DX heat pump system 50 that includes a compressor 1, an oil separator 3, a reversing valve 4, vapor refrigerant line 5, liquid refrigerant line 6, an optional receiver 10, and an accumulator 17. The general construction and function of these components are well understood by those skilled in the art and therefore are not shown or described in detail herein. The optional receiver 10 is illustrated in FIG. 1 in a cooling mode, where the refrigerant fluid exits at a base 14 of the receiver. The directional travel of the refrigerant fluid in the cooling mode is indicated by arrows 2.

The refrigerant fluid next flows to a self-adjusting cooling mode expansion device 23 and finned tubing 24 of an interior air handler. The finned tubing 24 may be disposed within an enclosure (not shown). A fan 25 may be positioned to blow interior air over the finned tubing 24. Heated or cooled refrigerant fluid passes through the finned tubing 24 to transfer heat with the interior air.

The refrigerant fluid next flows through a reversing valve 4 and then into the accumulator 17. Here, the accumulator 17 is of a unique design, as taught herein. A refrigerant suction line 16 to the accumulator 17 is shown as extending down below a liquid refrigerant level 30 within the accumulator 17. Further, the refrigerant suction line 16 to the accumulator 17, as it extends within the accumulator 17, has moderately sized upper holes 21 drilled in its walls above the liquid state refrigerant level 30, and has moderately sized lower holes 22 drilled in its walls above the liquid state refrigerant level 30, so as to be able to adjust the superheat to a temperature of between one-half degrees F. and ten degrees F. The superheat can be increased by drilling more upper holes 21 and fewer lower holes 22, and the superheat can be decreased by drilling additional lower holes 22 and fewer upper holes 21 within the refrigerant suction line 16.

The refrigerant fluid next passes through a refrigerant liquid filter 20 that prevents one of all and mostly all liquid refrigerant from entering a segment 29 of the refrigerant suction line extending from the accumulator 17 to the compressor 1.

The refrigerant fluid (now entirely, or nearly entirely, vapor) next flows into the compressor 1, where the vapor is compressed, raising its pressure and temperature. The hot gas refrigerant then travels into the oil separator 3, first entering through an oil filter 11 that is preferably a coalescent oil filter 11 capable of filtering to at least 0.3 microns, and that is at least 98%, and preferably 99%, efficient. An oil level 13 inside the separator 3 is maintained at a point beneath a base 14 of the oil filter 11, and the oil level 13 is monitored and easily checked by means of a sight glass 12. The oil may be returned to the compressor by means of an oil return line 15.

The oil return line 15 preferably enters the suction line segment 29 to the compressor 1 at an oil return point 27 disposed downstream of the accumulator 17, so that hot return oil does not affect (diminish) the liquid refrigerant level 30 within the accumulator 17, which is used to maintain a low superheat.

While primary oil return to the compressor 1 is achieved by means of the oil separator 3, the oil filter 11, and the oil return line 15 to the segment 29 of the suction line to the compressor 1, some minor amount of oil escapes the oil filter 11 (which is not 100% efficient) and mixes with the refrigerant circulating within the overall system. This oil is retrieved by means of a small orifice 19 at the bottom of a U-tube suction line 18 to the compressor 1 within the accumulator 17. Since the refrigerant liquid filter 20 inhibits oil return as well as liquid refrigerant, some small portion of liquid refrigerant and oil will be pulled into the compressor 1 by means of the small orifice 19. However, since most of the oil is returned via the oil separator 3 and its oil return line 15 that by-passes the accumulator 17, the orifice 19 size should preferably be decreased by at least 72% from the conventional 0.04 inch to 0.055 inch interior diameter commonly utilized for two to five ton system size design compressors 1. The orifice 19 size should be proportionately increased for larger sized compressors 1. One ton equals 12,000 BTUs, as is well understood by those skilled in the art.

When a U-tube suction line 18 is used within the accumulator 17, during non-operative system periods, the liquid refrigerant level 30 within the accumulator 17 can fill the lower segment of the U-tube 18. Thus, upon system start-up, it is preferable to have a bleed port hole 31 in the upper portion of the side of the U bend 18 that leads directly to the compressor 1, so as to avoid slugging the compressor 1 during system start-up. The preferable size of the bleed port hole 31 is between a 0.025 inch and a 0.03 inch diameter size per ton of system design capacity The refrigerant fluid, after exiting the oil separator 3, next passes through the reversing valve 4 and enters the subsurface geothermal heat transfer tubing 5 and 6 within the well/borehole 8, so as to be able to effect geothermal heat exchange from relatively stable and naturally occurring temperatures beneath the ground surface 7.

The geothermal heat transfer tubing 5 and 6 is herein shown as being comprised of a larger size vapor refrigerant transport line/tube 5 coupled via a refrigerant tube coupling 26 to a smaller size liquid refrigerant transport line 6 near the bottom of the well/borehole 8 (not drawn to scale). However, geothermal heat transfer tubing, shown here as 5 and 6, situated below the ground surface 7, can be of a variety of differing designs, as is well understood by those skilled in the art.

The refrigerant fluid exiting the well/borehole 8 next travels through the heating mode expansion device 9, which is inoperative in the cooling mode (as is well understood by those skilled in the art), and into the optional receiver 10. The refrigerant flow from a base 14 of the receiver 10 in the cooling mode, passed a cooling mode expansion device 23, and into the interior heat exchanger. The refrigerant flow path described above is then repeated.

Figure 2:
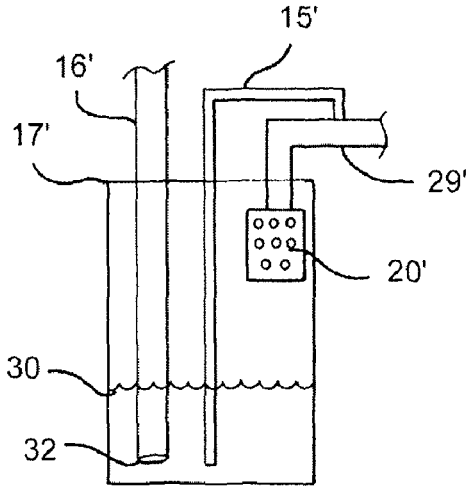
FIG. 2 is an enlarged, schematic side elevation view of an alternative embodiment of an accumulator for use in a DX system.

FIG. 2 shows an alternative embodiment of an accumulator 17' for use in a DX system. A refrigerant suction line 16' extends into the accumulator 17'. The refrigerant suction line 16', however, has no upper or lower holes in its sidewall (i.e., holes 21 and 22 in FIG. 1), as in the previous embodiment. Instead, the refrigerant suction line 16' includes an open distal end 32 disposed below the refrigerant level 30 through which the mostly refrigerant vapor exits.

A refrigerant liquid filter 20' is positioned near the top of the accumulator 17' and directly attached to a segment 29' of the suction line traveling to the compressor (not shown herein). Additionally, instead of a small orifice (19 in FIG. 1) in the bottom of a U bend (18 in FIG. 1), a small oil return line 15' is shown as extending from below the liquid refrigerant level 30 to the segment 29' of the suction line to the compressor, thereby totally by-passing the refrigerant liquid filter 20' which may otherwise inhibit oil return along with its intended inhibition of liquid phase refrigerant return.

The foregoing embodiments have been illustrated and described in the context of a geothermal, direct exchange heating/cooling system. It will be appreciated, however, that the improvements described herein may similarly be employed in any other type of heat pump system, including water- and air-source heat pumps.

While only certain embodiments have been set forth, alternatives and modifications will be apparent from the above description to those skilled in the art. These and other alternatives are considered equivalents and within the scope of this disclosure and the appended claims.

What is claimed is:

1. A heating/cooling system, comprising:

an exterior heat exchanger;

a compressor;

an oil separator;

heating and cooling mode expansion devices;

an interior heat exchanger;

an accumulator for holding liquid refrigerant, the liquid refrigerant defining a liquid refrigerant level within the accumulator;

a suction vapor line having a lower distal end disposed within the accumulator, the accumulator suction vapor line including at least one discharge hole situated below the liquid refrigerant level; and a compressor suction line having a first end in fluid communication with an interior of the accumulator and a second end in fluid communication with an interior of the compressor.

2. The system of claim 1, in which the suction vapor line lower distal end comprises an open end.

3. The system of claim 2, in which the suction vapor line includes no holes other than the open end.

4. The system of claim 1, further comprising a filter operably coupled to the compressor suction line first end, the filter being configured to prevent passage of liquid refrigerant.

5. The system of claim 1, further comprising an oil return line having a first end in fluid communication with an interior of the oil separator and a second end in fluid communication with the compressor suction line.

6. The system of claim 5, in which the oil separator is configured to be at least 98% efficient.

7. The system of claim 5, further comprising a coalescing filter disposed in the oil separator.

8. The system of claim 7, in which the coalescing filter is configured to be at least 99% efficient and to filter down to at least 0.3 microns.

9. The system of claim 5, in which the compressor suction line includes a U-bend disposed below the liquid refrigerant level in the accumulator, and a vapor bleed port is formed in a portion of the compressor suction line disposed within the accumulator and above the liquid refrigerant level.

10. The system of claim 9, in which the vapor bleed port has a diameter of approximately 0.025 to approximately 0.03 inches per ton of system design capacity.

11. The system of claim 5, in which the compressor suction line includes a U-bend disposed below the liquid refrigerant level in the accumulator, and in which an oil return orifice is formed at a base of the U-bend.

12. The system of claim 11, in which the oil return orifice has a diameter of approximately 0.02 to approximately 0.0396 inches for a compressor capacity of approximately 2 to 5 tons.

13. The system of claim 1, in which the exterior heat exchanger comprises a geothermal, sub-surface heat exchanger.

14. The system of claim 13, in which the geothermal, sub-surface heat exchanger extends to a depth of at least 100 feet, and in which the system uses an R-410A refrigerant.

15. The system of claim 14, further comprising a compressor lubricating oil rated for use in temperatures exceeding 200 degrees F.

16. The system of claim 15, in which the compressor lubricating oil comprises a Hatco 32 BCE lubricating oil.

* * * * *